US007832988B2

(12) United States Patent
Bergander et al.

(10) Patent No.: US 7,832,988 B2
(45) Date of Patent: Nov. 16, 2010

(54) TURBINE BLADE

(75) Inventors: Katharina Bergander, Berlin (DE); Georg Bostanjoglo, Berlin (DE); Tobias Buchal, Düsseldorf (DE); Winfried Eβer, Bochum (DE); Dirk Goldschmidt, Moers (DE); Torsten Koch, Oberhausen (DE); Rudolf Küperkoch, Essen (DE); Thorsten Mattheis, Mülheim (DE); Jan Münzer, Berlin (DE); Ralf Müsgen, Essen (DE); Matthias Oechsner, Mülheim an der Ruhr (DE); Ursula Pickert, Mülheim an der Ruhr (DE); Volker Vosberg, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 781 days.

(21) Appl. No.: 11/807,387

(22) Filed: May 29, 2007

(65) Prior Publication Data

US 2010/0014980 A1 Jan. 21, 2010

(30) Foreign Application Priority Data

May 31, 2006 (EP) ..... 06011253

(51) Int. Cl.
*F01D 5/18* (2006.01)

(52) U.S. Cl. ..... 416/233; 416/223 A

(58) Field of Classification Search ..... 416/232, 416/233, 228, 223 A, 224, 92, 500; 29/889.72
See application file for complete search history.

(56) References Cited

U.S. PATENT DOCUMENTS

| | | | | | |
|---|---|---|---|---|---|
| 994,166 | A | * | 6/1911 | Kienast | 416/233 |
| 1,829,179 | A | * | 10/1931 | Back | 416/232 |
| 2,689,107 | A | * | 9/1954 | Odegaard | 416/233 |
| 2,762,114 | A | * | 9/1956 | Steinhauer | 29/889.72 |
| 2,848,192 | A | * | 8/1958 | Hayes | 416/233 |
| 3,899,267 | A | | 8/1975 | Dennis et al. | |
| 4,411,597 | A | | 10/1983 | Koffel et al. | |
| 6,056,507 | A | | 5/2000 | Wheat et al. | |

FOREIGN PATENT DOCUMENTS

| | | |
|---|---|---|
| DE | 1 087 745 | 8/1960 |
| EP | 0 990 771 A1 | 4/2000 |
| EP | 1 283 325 A1 | 2/2003 |
| GB | 2027496 A1 | 2/1980 |
| GB | 2 106 997 A | 4/1983 |

* cited by examiner

*Primary Examiner*—Richard Edgar

(57) ABSTRACT

A turbine blade with an aerodynamically profiled blade leaf which is produced from two assembled shell elements is provided. The shell elements forming the suction-side and the pressure-side blade leaf wall have been assembled by a high-temperature and high-pressure bonding process. In the region of the blade leaf tip, a cramp is provided which hooks the two blade walls together with one another with a form fit.

12 Claims, 2 Drawing Sheets

TURBINE BLADE

CROSS REFERENCE TO RELATED APPLICATIONS

This application claims priority of European application No. 06011253.9 EP filed May 31, 2006, which is incorporated by reference herein in its entirety.

FIELD OF INVENTION

The invention relates to a turbine blade for a gas turbine, with a fastening and platform region, to which a blade leaf comprising at least two opposite shell elements and having a blade leaf tip is contiguous, which shell elements are connected to one another as a suction-side blade leaf wall and as a pressure-side blade leaf wall.

BACKGROUND OF INVENTION

EP 1 283 325 A1 discloses a gas turbine blade with an aerodynamically profiled blade leaf which is assembled from two shell elements. The two shell elements are firmly connected to one another along their longitudinal extent, on the inflow-edge side and on the outflow-edge side, by means of a high-pressure and high-temperature bonding process.

The known prior art has the disadvantage that the bonding connection of the longitudinally slotted blade leaf may possibly come loose in the region of the leaf tip and therefore the two individual shells may come apart during operation. This leads to flow losses during operation. Moreover, in individual instances, there is the risk that the two shell elements may come loose from one another completely and cause serious secondary damage in the turbine.

Furthermore, U.S. Pat. No. 3,899,267 discloses a closing insert for a blade leaf tip of a moving blade which is inserted in the region of the blade tip between the two side walls forming the blade leaf. In this case, the closing insert having a C-shape cross section is seated in two mutually opposite pockets which are provided in each case on the inside of the respective blade leaf wall. In order to protect the closing insert against loss, projections on the insides are provided which absorb the centrifugal forces acting on the closing insert.

SUMMARY OF INVENTION

An object of the invention is to provide a turbine blade of the type initially mentioned, in which the two shell elements are connected to one another securely.

A basic object is achieved by specifying a generic turbine blade in which the two shell elements are protected against coming apart in the region of the blade leaf tip by a form fit.

The invention proceeds from the recognition that, in individual instances, the connection made, for example, by means of the bonding process may not be sufficient to protect the two shell elements against coming apart. Therefore, by virtue of the invention, it is proposed that the two shell elements have in the region of the leaf tip a form fit which prevents the two shell elements from coming apart, that is to say moving away from one another, in the region of the blade leaf tip if the connection comes loose. Accordingly, with the turbine blade specified, a particularly reliable operation of a gas turbine can be afforded, insofar as this is equipped with a turbine blade according to the invention. Furthermore, the flow losses occurring when two shell elements come apart are effectively prevented. An impairment in the efficiency of the gas turbine will therefore not occur for these reasons.

Advantageous refinements are specified in the subclaims.

According to a first refinement of the invention, the form fit is formed by a hooking means which, arranged between the two shell elements, is hooked with each of the shell elements. In this case, the hooking direction is selected such that the two shell elements are reliably prevented from coming apart in the region of the blade leaf tip after the form fit has been made. Consequently, both shell elements have in each case on their inside, which in each case lies opposite their outside acted upon by hot gas, a hook which in each case comprises a projection approximately parallel to the blade leaf wall. With respect to this projection, the hooking means, preferably designed as a cramp of E-shaped cross section, has two opposite cramp ends which are formed complementarily to the hooks provided on the shell elements. Each cramp end can engage behind the projection provided on the hook, so that a movement of the shell elements away from one another if the connection comes loose is reliably avoided.

In addition, the hooking means may be connected by a force fit, that is to say soldered or welded, to at least one of the shell elements. A particularly reliable and also defined position of the hooking means with respect to the shell elements is thereby achieved. It therefore cannot come loose from its operating position and pass in an uncontrolled way into an inner space surrounded by the shell elements.

In order to propose a hooking means which can be installed particularly simply, this may also be of multipart design. What is achieved thereby is that it can comparatively easily be introduced and subsequently positioned between the mutually opposite shell elements through the orifice formed by these.

Preferably, the hooking means is provided between the two shell elements so that, if the turbine blade is designed as a moving blade, it is protected against coming loose under the action of centrifugal force on account of the hooks arranged on the insides of the blade leaf walls. In order further to reduce flow losses when the gas turbine is in operation, the hooking means may also be fastened as a crown on the blade leaf tip on which, furthermore, brushing edges may be provided. By means of the brushing edges, a particularly small radial gap between the blade leaf tip and the gas duct boundary wall lying opposite this can be achieved.

In a further advantageous refinement, each shell element comprises a hook, said hooks, formed complementarily to one another, engaging one in the other as hooking means. A separate component for hooking is not required in this case. One of the two hooks projects toward the blade tip and the other of the two hooks projects toward the blade root. To afford hooking against coming apart on the blade-tip side, the two not yet connected shell elements bearing against one another in a radially offset manner are displaced in the radial direction until the blade root and blade tip of the two shell elements lie in each case, flush, opposite one another and the two hooks engage one in the other with a form fit. The two shell elements are subsequently connected permanently and firmly to one another. Insofar as the turbine blade is equipped as a moving blade with a root of hammer-shaped or pinetree-shaped cross section, which is pushed into a matching groove for fastening to the rotor of the turbine, the blade root pushed into the groove also protects the hooking arrangement against unintentionally coming loose, since, with the turbine blade mounted, a radial displacement of the two shell elements is not possible.

BRIEF DESCRIPTION OF THE DRAWINGS

An exemplary embodiment of the invention is explained in more detail below with reference to a drawing in which, partially diagrammatically and not true to scale.

DETAILED DESCRIPTION OF INVENTION

Figure 1:
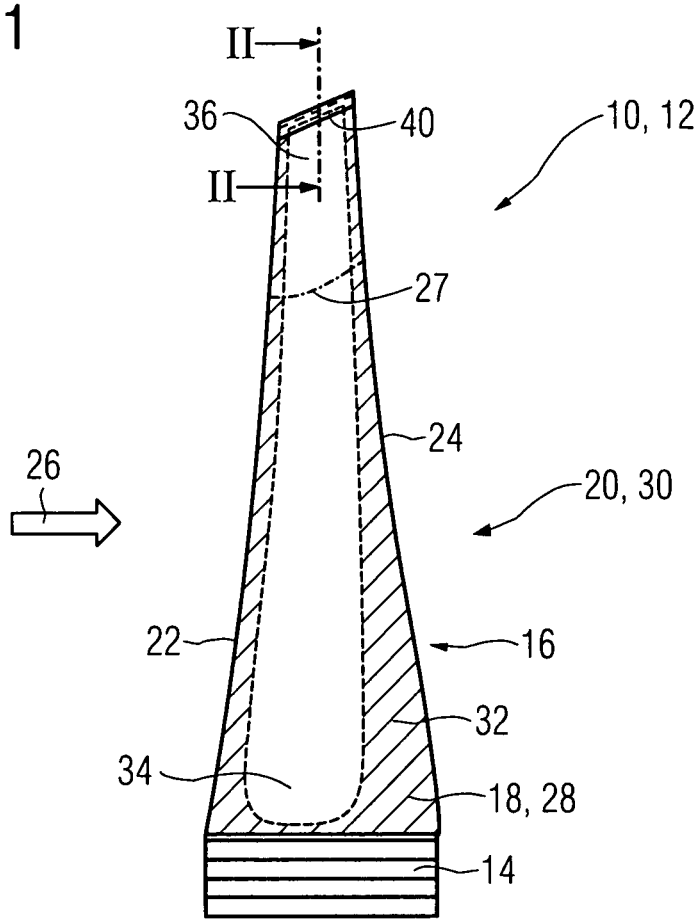
FIG. 1 shows a gas turbine moving blade in a side view.

A modular turbine blade 10 for a preferably stationary gas turbine is depicted in FIG. 1. The turbine blade 10 is illustrated in the form of a moving blade 12 which has a fastening and platform region 14 for fastening in a groove, not illustrated, of a rotor disc. The fastening region is designed as a moving blade root of pinetree-shaped or hammer-shaped cross section. Contiguous to the fastening and platform region 14 is an aerodynamically profiled blade leaf 16 which has an essentially convexly curved suction-side blade leaf wall 18 and an essentially concavely curved pressure-side blade leaf wall 20 lying opposite the latter. The two blade leaf walls 18, 20 extend along a chord 27 from an inflow-side leading edge 22 to an outflow-side trailing edge 24 with respect to the hot-gaseous working medium 26 flowing around the blade leaf 16 when the gas turbine is in operation.

The suction-side blade leaf wall 18 is formed by a first shell element 28 and the pressure-side blade leaf wall 20 by a second shell element 30. The two shell elements 28, 30 are connected to one another permanently and firmly in a connection region 32, illustrated by hatching, on the leading-edge side and on the trailing-edge side by means of a high-pressure and high-temperature bonding process. Between the two connection regions 32 lies an inner space 34 which is surrounded by the shell elements 28, 30 and which extends inside the blade leaf 16 from the fastening-side end to a blade leaf tip 36.

Figure 2:
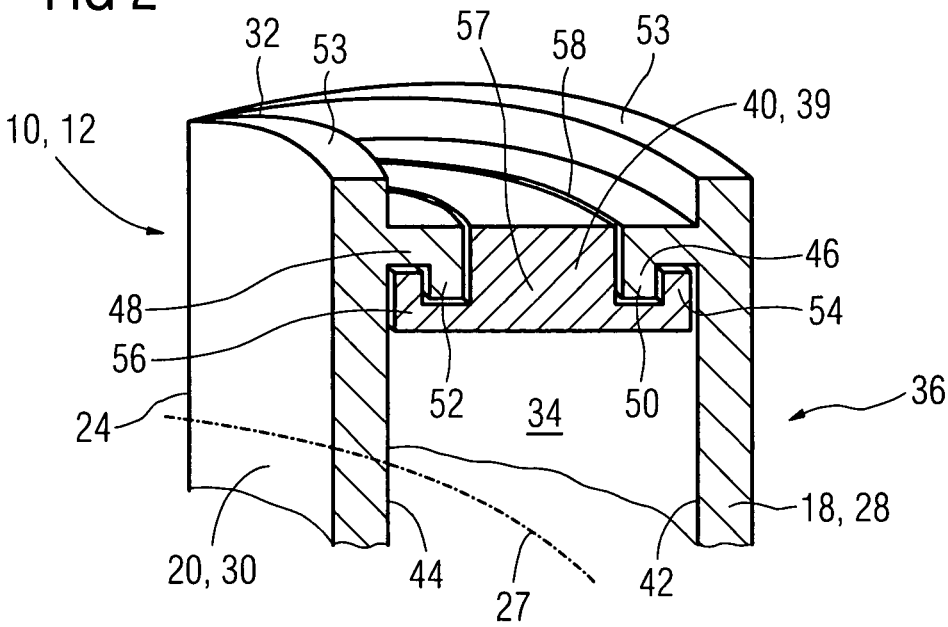
FIG. 2 shows the blade leaf tip of the gas turbine moving blade according to FIG. 1 FIG. 1 in cross section in a first embodiment.

In order to effectively prevent the two shell elements 28, 30 from coming apart in the region of the blade leaf tip 36, a cramp 40 is provided as hooking means 39 in this region. In this respect, FIG. 2 shows a cross section along the sectional line II-II from FIG. 1. On an inside 42, 44 of the blade leaf wall 18, 20, which in each case lies opposite the outside, acted upon by hot gas, of the blade leaf wall 18, 20, is provided in each case a hook 46, 48 which extends along the chord 27 and which in each case comprises a projection 50, 52 extending essentially parallel to the blade leaf walls 18, 20. As a cramp 40 of E-shaped cross section, this has two opposite cramp ends 54, 56 which are in each case designed complementarily to the hooks 46, 48 arranged on the shell elements 28, 30 and which engage with a form fit behind the projections 50, 52 of said hooks. With respect to the installation position in a gas turbine, the projections 50, 52 extend in the radial direction, preferably inward. This results in a hooking arrangement in which the cramp 40 is protected in the direction of the centrifugal force against coming loose from the hooks 46, 48.

The middle region 57 of the E-shaped cramp 40 fills the region between the two projections 50, 52, so that two projecting sealing lips 53 are formed on the blade leaf tip 36. At the same time, the cramp 40 closes the inner space 34 at the blade leaf tip 36, thus avoiding a possibly harmful penetration of hot working medium 26.

Since the projections 50, 52 are hooked together, in a direction perpendicular to the radial direction, with the cramp ends 54, 56 lying opposite one another, the two shell elements 28, 30 cannot come apart on account of the form-fit connection. The direct bearing of the shell elements 28, 30 one against the other between the leading edge 22 and trailing edge 24 in the region of the leaf tip 36 is also avoided by means of the cramp 40 which then acts as a spacer.

Figure 3:
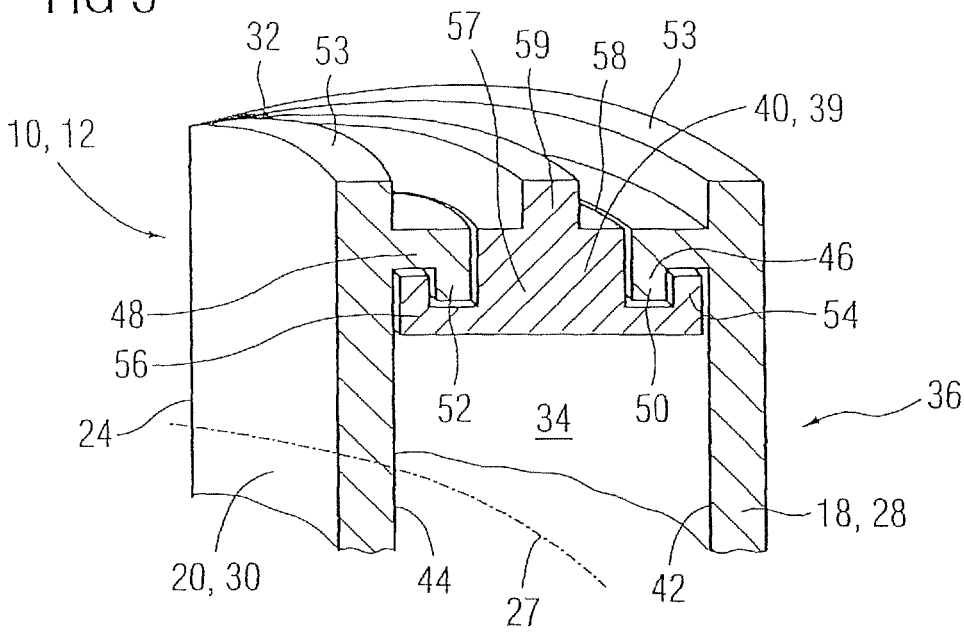
FIG. 3 shows the blade leaf tip of the gas turbine moving blade according to FIG. 1 in cross section in a second embodiment.
Figure 4:
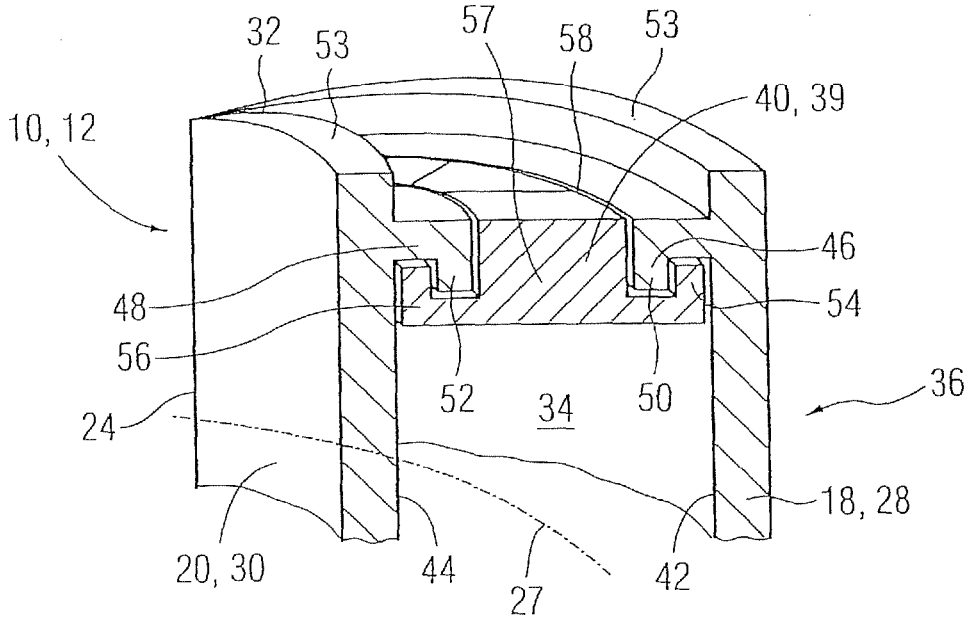
FIG. 4 shows the blade leaf tip of the gas turbine moving blade according to FIG. 1 in cross section in a third embodiment.

In order to provide a particularly secured hooking means 39, this may be soldered or welded in spots or along the butt seam 58 to at least one of the shell elements 28, 30. Also, the hooking means 39 and/or the hooks 46, 48 may in each case be subdivided along the chord 27 into a plurality of segments. FIG. 4 shows the blade leaf tip 36 of the gas turbine moving blade 12 according to FIG. 1 in cross section, wherein the hooking means 39/cramp 40 has a plurality of separate parts. The multipart hooking means 39 can then be mounted particularly simply or the one-piece cramp 40 can then be introduced particularly simply into the inner space 34. Optionally, in the middle region 57 of the hooking means 39 or of the cramp 40, a radially outward-directed brushing edge may be provided, which further improves the sealing action between the blade leaf tip 36 and a boundary wall lying opposite during operation. FIG. 3 shows the hooking means 39/cramp 40 having a middle region 57 with a radially outward-directed brushing edge 59.

Instead of the hooking arrangement 39 shown, the shell elements 28, 30 may also be hooked directly together with one another. The solution shown in FIG. 2 may be modified in such a way that, on the one hand, the two hooks 46, 48 are extended toward the opposite shell element 30, 28 and, on the other hand, one of the hooks 46, 48 projects, instead of radially inward, that is to say toward the blade root, radially outward, that is to say toward the blade leaf tip 36, so that these hooks can then engage with a form fit one in the other. In this instance, there is then no need for a separate component as hooking means 39.

The invention claimed is:

1. A turbine blade for a gas turbine, comprising:

a fastening region;

a platform region; and a leaf blade with a blade leaf tip and two opposite shell elements, the leaf blade being contiguous to the platform region, and the two shell elements being protected against coming apart based upon a form fit connection in a region of the blade leaf tip, wherein the shell elements are connected to one another to form a suction-side blade leaf wall and a pressure-side blade leaf wall, wherein the form fit connection is based upon a hooking device arranged between the two shell elements, the hooking device being hooked with the two shell elements, wherein the hooking device is a separate cramp with two opposite cramp ends to engage into complementarily designed hooks arranged at each shell element, each hook comprising a projection and the cramp ends engaging with a form fit behind the projections, and wherein the projections extend in an radial direction with regard to an installation position in the gas turbine.

2. The turbine blade as claimed in claim 1, wherein the cramp has a E-shaped cross section.

3. The turbine blade as claimed in claim 1, wherein the hooking device is soldered or welded to at least one of the shell elements.

4. The turbine blade as claimed in claim 1, wherein the hooking device has a plurality of separate parts.

5. The turbine blade as claimed in claim 1, wherein the hooking device has a brushing edge.

6. The turbine blade as claimed in claim 1, wherein the hooking device delimits an inner space partially surrounded by the shell elements toward the blade leaf tip.

7. A gas turbine, comprising:

a turbine blade, the turbine blade comprising:

a fastening, a platform, and a leaf blade with a blade leaf tip and two opposite shell elements, the leaf blade being contiguous to the platform, and the two shell elements being protected against coming apart based upon a form fit connection in an area of the blade leaf tip, wherein the shell elements are connected to one another to form a suction-side blade leaf wall and a pressure-side blade leaf wall, wherein the form fit connection is based upon a hooking device arranged between the two shell elements, the hooking device being hooked with the two shell elements, wherein the hooking device is a separate cramp with two opposite cramp ends to engage into complementarily designed hooks arranged at each shell element, each hook comprising a projection and the cramp ends engaging with a form fit behind the projections, and wherein the projections extend in an radial direction with regard to an installation position in the gas turbine.

8. The gas turbine as claimed in claim 7, wherein the cramp has a E-shaped cross section.

9. The gas turbine as claimed in claim 7, wherein the hooking device is soldered or welded to at least one of the shell elements.

10. The gas turbine as claimed in claim 7, wherein the hooking device has a plurality of separate parts.

11. The gas turbine as claimed in claim 7, wherein the hooking device has a brushing edge.

12. The gas turbine as claimed in claim 7, wherein the hooking device delimits an inner space partially surrounded by the shell elements toward the blade leaf tip.

* * * * *